United States Patent [19]

Watson et al.

[11] 4,304,056

[45] Dec. 8, 1981

[54] SNOW PLOW MOUNTING ASSEMBLY

[75] Inventors: Gary E. Watson, Mequon; Edward A. Simi, Menomonee Falls, both of Wis.

[73] Assignee: Douglas Dynamics, Inc., Milwaukee, Wis.

[21] Appl. No.: 163,646

[22] Filed: Jun. 27, 1980

[51] Int. Cl.[3] ..... E02F 3/76

[52] U.S. Cl. ..... 37/41; 37/42 R

[58] Field of Search ..... 37/41, 42 R, 42 VL, 37/50, 117.5; 172/816, 817, 828, 820

[56] References Cited

U.S. PATENT DOCUMENTS

| | | | |
|---|---|---|---|
| 3,307,275 | 3/1967 | Simi | 37/42 R |
| 3,410,008 | 11/1968 | Standfuss | 37/42 R |
| 3,605,906 | 9/1971 | Coates | 37/42 R X |
| 3,828,449 | 8/1974 | Miceli | 37/41 |
| 4,215,496 | 8/1980 | Wehr | 37/42 R X |
| 4,236,329 | 12/1980 | Hetrick | 37/42 R |

*Primary Examiner*—E. H. Eickholt

[57] ABSTRACT

A snow plow assembly adapted to be conveniently mounted on a vehicle. The snow plow assembly includes a vertical frame assembly adapted to be mounted to the vehicle bumper and secured to the vehicle frame. Bracket members are fixedly secured to the opposite lateral sides of the vertical frame and each include a forwardly extending portion bolted to the bumper and a rearward portion bolted to the vehicle frame. Also included is a thrust member having opposite ends, one of its opposite ends being fixedly secured to the lower portion of the vertical frame and an opposite end secured to the vertical frame. The snow plow assembly also includes a plow blade, a frame member having opposite ends and for supporting the plow blade, one of the frame member opposite ends supporting the plow blade and the other of the frame member opposite ends being pivotably joined to the vertical frame. Also included is a motor for lifting the plow blade.

12 Claims, 7 Drawing Figures

SNOW PLOW MOUNTING ASSEMBLY

FIELD OF THE INVENTION

The invention is related to snow plows adapted to be mounted on a vehicle and more particularly to a light weight snow plow for residential use with two wheel drive pick-up trucks and the like and to a frame assembly for a snow plow which permits the snow plow to be easily attached to a variety of common vehicles yet which provides rigid support for the snow plow.

BACKGROUND PRIOR ART

An example of a prior art snow plow is illustrated in the U.S. Simi Pat. No. 3,307,275, issued Mar. 7, 1967.

SUMMARY OF THE INVENTION

The present invention is particularly directed to a mounting assembly for supporting a snow plow such as that shown in the Simi patent referred to above and wherein the mounting assembly is particularly constructed to provide a means for supporting a snow plow such that the snow plow can be mounted on a vehicle without special tools and without modifications of the vehicle or the vehicle frame being required. The snow plow assembly and the mounting frame are also designed such that substantially the same frame structure can be bolted to various conventional vehicles with a minimum of expense or labor yet providing a supporting frame for the snow plow which is capable of withstanding the heavy loads applied to the frame during plowing operations.

More particularly, the snow plow includes a snow plow assembly adapted to be mounted on a vehicle and including a vertical frame and means for fixedly securing the vertical frame to the vehicle bumper and to the vehicle frame. The securing means includes a pair of attachment members or bracket members, the attachment members being secured to opposite lateral sides of the frame, each of the attachment members including a forward portion adapted to be bolted to the vehicle bumper and a rearward portion adapted to be bolted to the vehicle frame. Means are also provided for attaching the lower portion of the vertical frame to the vehicle frame, and including an elongated member having one end being bolted to the lower portion of the vertical frame and an opposite end connected to the vehicle frame.

The invention also includes a frame for a snow plow assembly which is particularly constructed such that when the snow plow is removed, the frame is also functional to support decorative and functional attachments such as a spare tire mounting bracket and a brush guard.

Various other features of the invention are set forth in the following description of a preferred embodiment, in the drawings, and in the claims.

Figure 1:
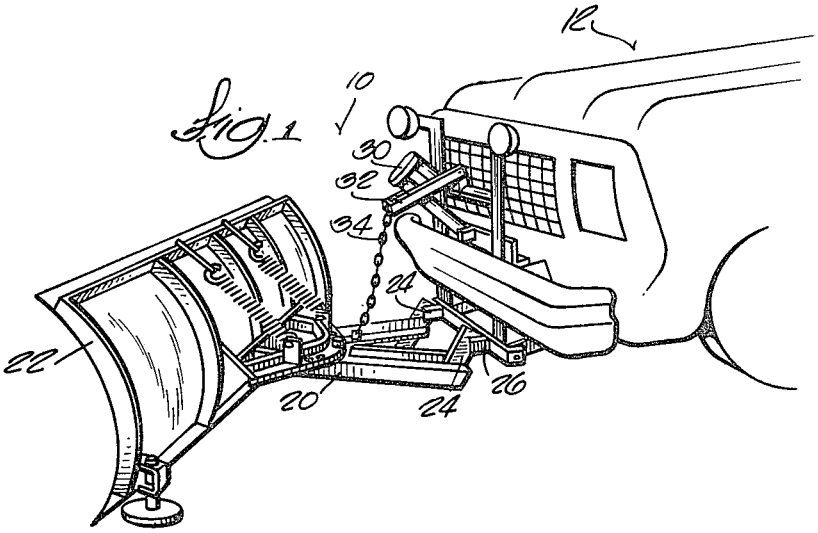
FIG. 1 is a perspective view of a snow plow assembly embodying the invention and shown as being mounted on a vehicle.

Before explaining at least one embodiment of the invention in detail, it is to be understood that the invention is not limited in its application to the details of construction and the arrangement of the components set forth in the following description or illustrated in the drawings. The invention is capable of other embodiments and of being practiced and carried out in various ways. Also, it is to be understood that the phraseology and terminology employed herein is for the purpose of description and should not be regarded as limiting.

DESCRIPTION OF A PREFERRED EMBODIMENT

Figure 2:
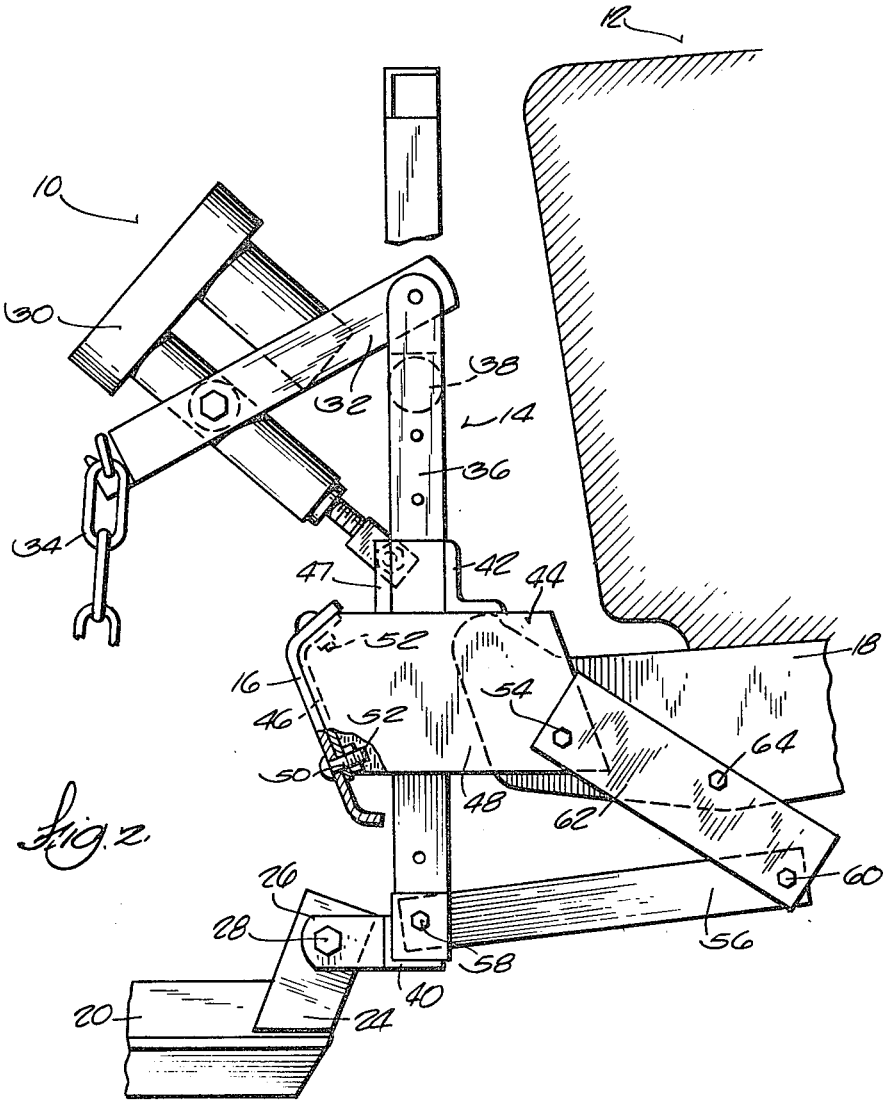
FIG. 2 is an enlarged elevation view of a portion of the snow plow supporting assembly illustrated in FIG. 1.

With particular reference to FIGS. 1 and 2 of the drawings, a snow plow assembly 10 is shown as being mounted on the front end of a vehicle 12. The snow plow assembly 10 generally includes a generally vertically extending mounting frame 14 bolted to the vehicle bumper 16 and to the vehicle frame 18 as will be described in greater detail hereinafter. The snow plow assembly 10 also includes an A-shaped plow blade supporting frame 20 extending forwardly from the lower portion of the vertical mounting frame 14 and supporting a plow blade 22 at its forward end. The plow blade supporting frame 20 is pivotably attached to the lower portion of the vertical supporting frame 14 in such a manner as to be pivotable about a horizontal axis. More particularly, the A-shaped plow blade supporting frame 20 includes two rearwardly and upwardly extending arms 24. The vertical frame assembly 14 includes a pair of laterally spaced apart brackets 26 which extend forwardly from the lower portion of the vertical frame 14. The arms 24 of the frame 20 are pivotally connected to the brackets 26 by means of bolts 28, such that the plow blade supporting frame 20 is supported for pivotal movement about a horizontal axis.

Means are also provided for selectively and alternatively lifting and lowering the forward end of the plow blade supporting frame 20 to thereby cause vertical movement of the plow blade 22, the lifting means being illustrated as including an electrically driven linear actuator 30 adapted to cause pivotal movement of a forwardly extending lifting arm 32. The forward end of the lifting arm 32 supports an end of a chain 34, and the chain 34 is in turn connected to the forward end of the plow blade supporting frame 20. It will be readily understood by those skilled in the art that the lifting means could also comprise suitable hydraulic apparatus. A more detailed description of the lifting apparatus is set forth in my co-pending U.S. patent application Ser. No. 163,563, filed June 27, 1980 and titled "Snow Plow Assembly Including Linear Actuator", that patent application being assigned to the assignee of the present invention.

Figure 3:
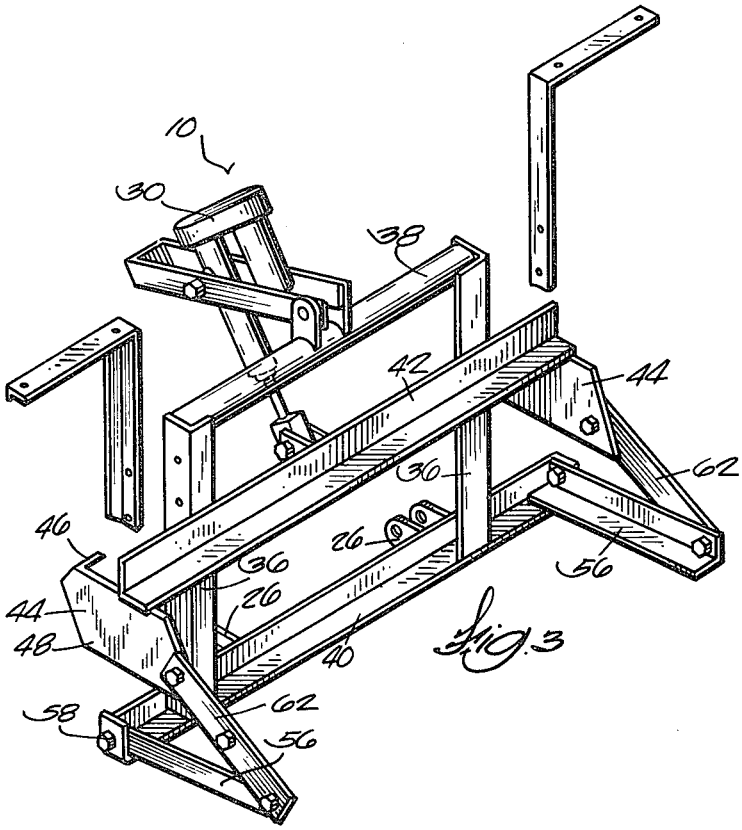
FIG. 3 is a perspective view of the snow plow mounting assembly shown in FIG. 2.

Referring more specifically to the vertically extending mounting frame 14, it is illustrated in FIGS. 2 and 3 as comprising a rigid vertically extending generally rectangular frame formed by a pair of vertically extending bars or angles 36, the upper ends of the vertical bars 36 being joined by a horizontal bar 38 welded therebetween and a lower horizontal bar 40 welded to the lower ends of the vertical bars 36. In the illustrated construction the vertical bars 36 are each comprised of elongated angles and the upper horizontal bar 38 is comprised of a cylindrical pipe welded at its opposite ends to the upper ends of the elongated vertical angles 36. The lower horizontal member 40 is comprised of another elongated angle having a length greater than that of the upper horizontal bar 38 such that its ends extend outwardly beyond the lower ends of the vertical bars 36, and the lower ends of the vertical bars 36 are welded to the elongated angle forming the lower horizontal frame member 40.

The vertical frame 14 also includes another elongated horizontal frame member 42 parallel to the upper and lower horizontal frame members 38 and 40 and generally intermediate those frame members, the intermediate frame member 42 being welded at its opposite ends to the two vertical bars 36 and including ends which extend outwardly from the vertical bars.

The brackets 26 are spaced apart along the length of the lower frame member 40 and are welded to the lower frame members so as to project forwardly thereform so as to receive the arms 24 of the plow mounting frame 20. The vertical frame assembly also includes a pivot bracket 45 comprised of a pair of flanges welded to the upper horizontal bar 38 and adapted to pivotably house one end of the lifting arm 32. The frame 14 also includes another bracket 47 comprised of a pair of flanges welded to the intermediate frame member 42 and adapted to pivotably support the lower end of the linear actuator 30.

Means are also provided for facilitating the convenient attachment of the vertical frame 14 to the frame 18 of the vehicle 12. This means includes a pair of bracket members 44 welded to the opposite ends of the intermediate frame member 42 and being adapted to be bolted to both the vehicle bumper 16 and the vehicle frame 18. As illustrated in FIGS. 2 and 3, the bracket members 44 are each generally planar and lie in a vertical plane generally perpendicular to the longitudinal axis of the intermediate frame member 42, and also include a forward portion 46 which extends transversely to the body portion or rearwardly extending plate portion 48 of the brackets 44. The transverse or angular portion 46 of the brackets 44 have a surface configuration which is adapted to be received in mating engagement with the rear surface of the vehicle bumper 16. The angular portions 46 of the brackets 44 also include bores 50 therethrough, the bores 50 being located so as to house the carriage bolts 52 commonly employed to secure the bumper 16 to the bumper bracket (not shown) of the vehicle. The rearward portions of the mounting brackets 44 are provided with bores therethrough whereby the mounting brackets can be secured to the forward end of the vehicle frame 18 by bolts 54.

A vehicle frame 18 of a conventional pickup truck usually includes bores or slots generally in the area of the bolt 54 illustrated in FIG. 2. One of the advantages of the invention is that the bores in the mounting brackets 44 are located so as to permit a bolt to extend through pre-existing holes or slots in the vehicle frame and thereby avoid the requirement of drilling holes in the vehicle frame to permit attachment of the snow plow supporting assembly.

The vertical frame 14 also includes means for fixedly connecting the lower ends of the vertical frame members 36 to the vehicle frame 18. While various arrangements can be provided, in the illustrated construction, this connecting means comprises a pair of elongated thrust bars or angles 56 joining the opposite ends of the lower horizontal bar 40 to the vehicle frame 18. The elongated thrust bars 56 each include a forward end adapted to be fixedly secured by bolts 58 to the outwardly extending end of the lower horizontal bar 40 and a rearward end adapted to be fixedly secured by bolts 60 to the rearward end of a diagonal plate 62, which is welded or otherwise fixedly secured to the rearward end of the plate portion 48 of the bracket member 44, and extends downwardly and rearwardly therefrom. The diagonal plate 62 is secured to the vehicle frame by the bolt 54 and by a second bolt 64 extending through a bore in the frame 18. In other embodiments of the invention, the rearwardly extending end of the elongated thrust bars 56 can be bolted directly to the vehicle frame 18 rather than to the diagonal plate 62.

In mounting of the snow plow mounting assembly 10 on a vehicle 12, the vertical frame assembly 14 can be conveniently mounted by first removing the bolts 52 supporting the vehicle's front bumper 16 to thereby permit removal of the bumper. The bolts 54 and 64 adapted to secure the bracket members 44 to the vehicle frame, are then inserted through the plate portions 48 of the bracket members and through the diagonal plates 62 into the holes provided in the vehicle frame. The elongated thrust bars 56 are then bolted in place between the downwardly extending end of the diagonal plate 62 and the lower end of the vertical frame member. The bumper 16 is then replaced with the bolts 52 extending through the bumper 16 and through the bores 50 provided in the angular portions 46 of the bracket members 44.

When the vertical mounting assembly is attached to the vehicle frame in this fashion, the forward portions of the mounting brackets 44 are bolted to the bumper, and the rearward or plate portions of the mounting brackets 44 are bolted directly to the vehicle frame 18. The vertical mounting assembly 14 is also connected to the frame 18 by means of the thrust bars 56 extending between the lower portion of the vertical frame 14 and either the diagonal plates 62 or the vehicle frame itself.

One of the advantages of the present invention is that the vertical mounting assembly 14 is readily mounted on a vehicle without special tools, structural modification of the vehicle frame or welding, yet the vertical mounting assembly provides a rigid supporting structure for a snow plow, the supporting structure being capable of withstanding the forces and impact on the plow frame during plowing.

Figure 4:
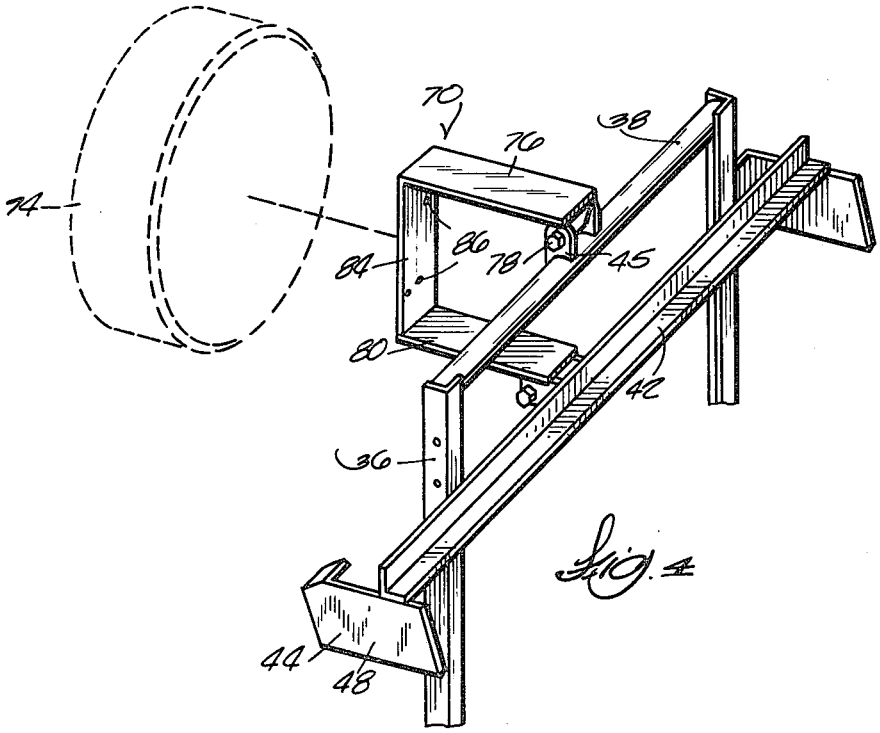
FIG. 4 is a perspective view similar to FIG. 3 but showing the snow plow supporting assembly adapted for use in supporting a spare tire.
Figure 5:
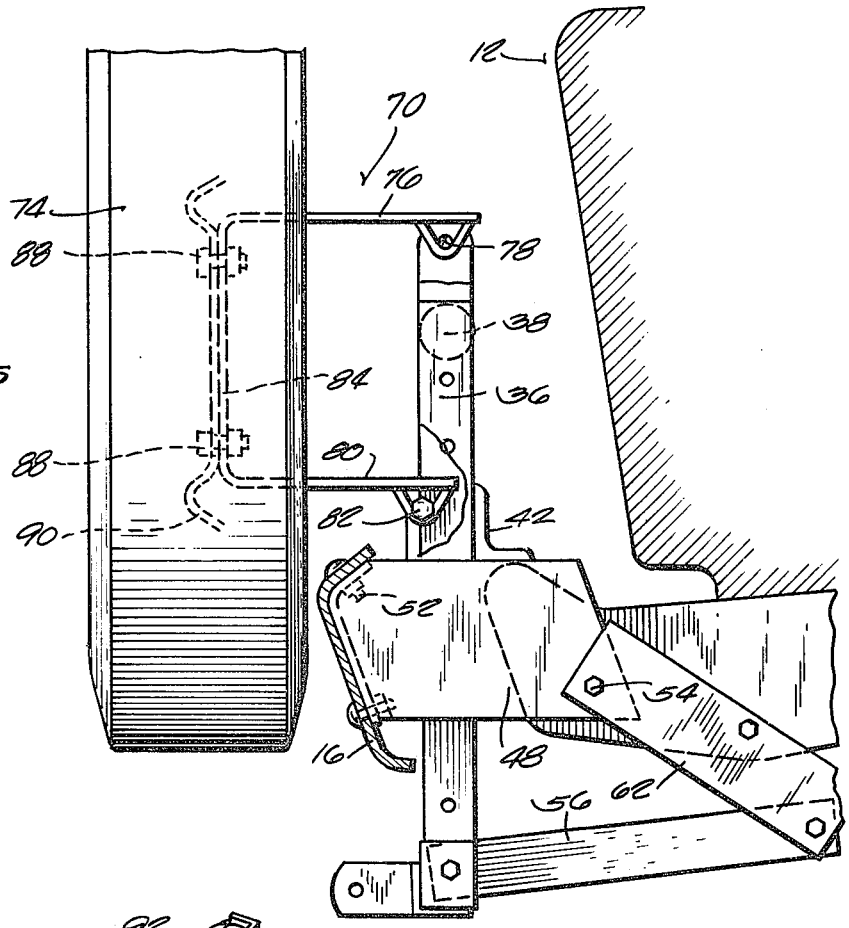
FIG. 5 is a view similar to FIG. 2 and showing the snow plow supporting assembly adapted for use in supporting a spare tire.
Figure 6:
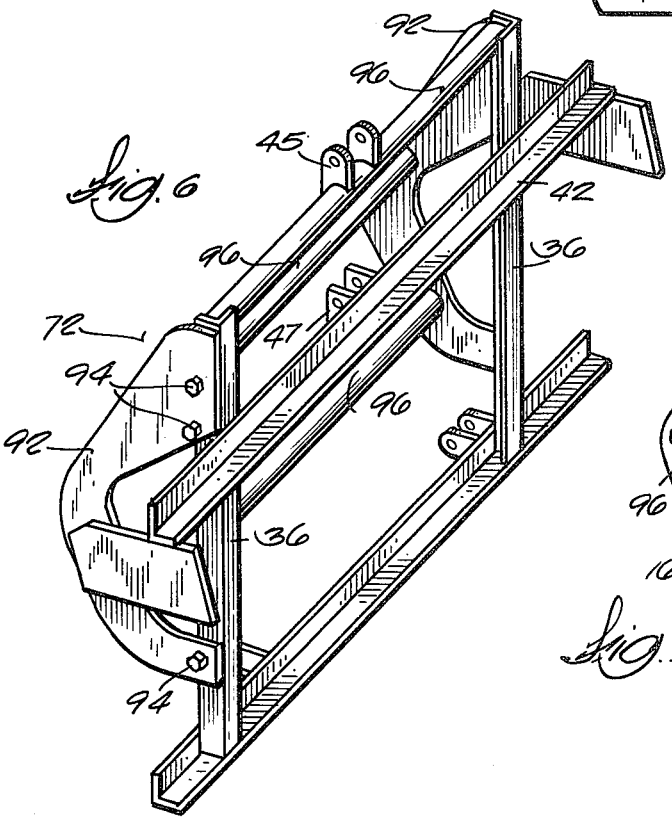
FIG. 6 is a view similar to FIG. 3 but showing the snow plow mounting assembly adapted to support a brush guard.
Figure 7:
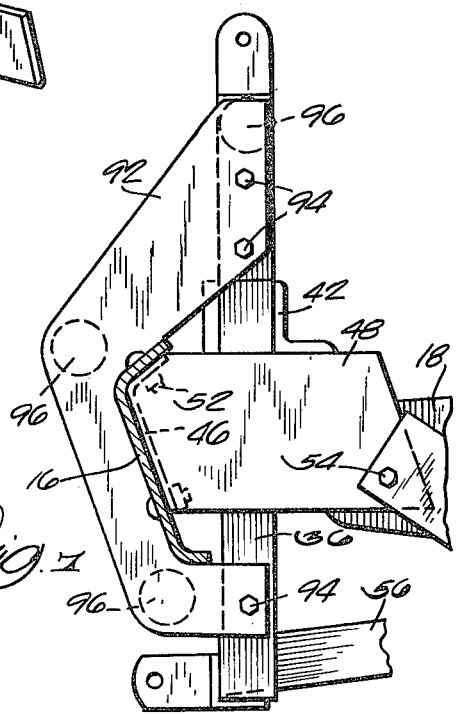
FIG. 7 is a side elevation view of the snow plow mounting assembly and brush guard shown in FIG. 6.

Another of the advantages of the invention is that the vertical mounting assembly is also particularly adapted to support functional and decorative attachments when the snow plow is detached from the mounting assembly, such attachments shown by way of example as comprising a spare tire mounting bracket 70 shown in FIGS. 4 and 5 and a brush guard 72 shown in FIGS. 6 and 7.

Referring more particularly to the spare tire mounting bracket 70, as illustrated in FIGS. 4 and 5, the mounting bracket is intended to provide a convenient means for carrying a spare tire 74, and is comprised of a U-shaped member having an upper horizontally extending leg 76 which can be conveniently secured by a bolt 78 to the bracket 45 welded to the upper horizontal frame member 38. The tire mounting bracket 70 further includes a lower horizontally extending leg 80 which can be secured by a bolt 82 to the bracket 47 welded to the intermediate frame member 42. The mounting bracket 70 also includes a vertical plate portion 84 including a pair of bores 86 therethrough, the bores 86 being adapted to receive bolts 88 whereby the wheel 90 of the spare tire 74 can be mounted in the manner illustrated in FIG. 4.

The brush guard 72, best shown in FIGS. 6 and 7, is comprised of a pair of lateral plates 92 adapted to be secured by bolts 94 to the vertically extending members 36 of the vertical frame assembly 14 and to project forwardly of the vehicle bumper 16. The brush guard 72 also includes horizontal bars 96 extending between the lateral plates and adapted to be positioned somewhat in front of the bumper 16 to provide protection for the bumper. The brush guard 72 is readily secured to the vertical frame assembly 14 by merely bolting the lateral plates 92 to the vertically extending support bars 36 of the vertical frame 14.

Various features of the invention are set forth in the following claims.

We claim:

1. A snow plow assembly adapted to be mounted on a vehicle including a frame and a bumper supported by the vehicle frame and for supporting a snow plow, the snow plow assembly including a vertical frame having an upper portion and a lower portion, and means for fixedly securing said vertical frame to said bumper and to said vehicle frame, said securing means including a pair of bracket members, one of said bracket members being rigidly secured to one lateral side of said vertical frame intermediate its upper and lower portion and a second bracket member being rigidly secured to the opposite lateral side of said vertical frame intermediate its upper and lower portions, each of said bracket members including a forward portion adapted to be bolted to the bumper and including a rearward portion adapted to be rigidly secured to the vehicle frame, and means for rigidly connecting the lower portion of said vertical frame to said vehicle frame, said means including an elongated member having opposite ends, one of said opposite ends being fixedly connected to said lower portion of said vertical frame and the other of said opposite ends of said elongated member being adapted to be connected to said vehicle frame.

2. The snow plow assembly as set forth in claim 1 wherein said vertical frame is comprised of a pair of vertical bars, an upper cross bar extending between said vertical bars and fixedly secured to each of said vertical bars, a lower cross bar fixed to the lower ends of each of said vertical bars, said lower cross bar having opposite ends, and an intermediate cross bar generally parallel to said upper and lower cross bars and rigidly secured to said vertical bars intermediate said upper and lower cross bars, said intermediate cross bar having opposite ends extending laterally outwardly from said vertical bars, and wherein said bracket members are carried by said opposite ends of said intermediate cross bar.

3. The snow plow assembly set forth in claim 1 wherein said bumper includes a rear surface and wherein said forward portion is adapted to be fixedly secured against the rear surface of said bumper and wherein said rearward portion comprises a plate defining a generally vertical plane transverse to said forward portion and extending rearwardly from said forward portion.

4. The snow plow assembly as set forth in claim 1 and further including means for supporting a tire, said tire supporting means being supported by said vertical frame and extending forwardly from said vertical frame.

5. The snow plow assembly as set forth in claim 1 and further including a brush guard extending forwardly from said vertical frame, said brush guard including a pair of parallel spaced plates, one of said plates being fixed to one of said lateral sides of said vertical frame and the other of said plates being fixed to the other of said lateral sides of said vertical frame, said plates extending forwardly from said vertical frame, and a plurality of elongated bars extending between said plates, said bars each having opposite ends fixedly joined to said plates.

6. The snow plow assembly set forth in claim 5 wherein said bumper includes a rear surface and wherein said forward extending portion is adapted to be fixedly secured against the rear surface of said bumper and wherein said rearward portion comprises a plate defining generally vertical plane transverse to said forward portion and extending rearwardly from said forward portion.

7. The snow plow assembly as set forth in claim 5 wherein said vertical frame is comprised of a pair of vertical bars, an upper cross bar extending between said vertical bars and fixedly secured to each of said vertical bars, a lower cross bar fixed to the lower ends of each of said vertical bars, said lower cross bar having opposite ends, and an intermediate cross bar generally parallel to said upper and lower cross bars and rigidly secured to said vertical bars intermediate said upper and lower cross bars, said intermediate cross bar having opposite ends extending laterally outwardly from said vertical bars, and wherein said bracket members are carried by said opposite ends of said intermediate cross bar.

8. The snow plow assembly as set forth in claim 1 wherein said vertical frame is comprised of a pair of vertical bars, an upper cross bar extending between said vertical bars and fixedly secured to each of said vertical bars, a lower cross bar fixed to the lower ends of each of said vertical bars, said lower cross bar having opposite ends, and an intermediate cross bar generally parallel to said upper and lower cross bars and rigidly secured to said vertical bars intermediate cross bar having opposite ends extending laterally outwardly from said vertical bars, and wherein said bracket members are carried by said opposite ends of said intermediate cross bar.

9. The snow plow assembly as set forth in claim 7 and further including means for supporting a tire, said tire supporting means being supported by said vertical frame.

10. The snow plow assembly as set forth in claim 7 and further including a brush guard extending forwardly from said vertical frame, said brush guard including a pair of parallel spaced plates, one of said plates being fixed to one of said lateral sides of said vertical frame and the other of said plates being fixed to the other of said lateral sides of said vertical frame, said plates extending forwardly from said vertical frame, and a plurality of elongated bars extending between said plates, said bars each having opposite ends fixedly joined to said plates.

11. A snow plow assembly adapted to be mounted on a vehicle including a frame and a bumper supported by the vehicle frame, the snow plow assembly comprising a vertical frame, means for mounting the vertical frame rearwardly of the vehicle bumper and for fixedly securing the vertical frame to the bumper and to the vehicle frame, the mounting means including a bracket member fixedly secured to said vertical frame, said bracket member including a forwardly extending portion bolted to the bumper and a rearward portion bolted to the vehicle frame, and a member having opposite ends, one of said opposite ends being fixedly secured to the lower portion of said vertical frame and an opposite end secured to the vehicle frame, a plow blade, means for supporting the plow blade including a frame member having opposite ends, one of said frame member opposite ends supporting the plow blade and the other of said frame member opposite ends being pivotably joined to the vertical frame, and means for lifting said plow blade, said means including motor means supported by said vertical frame above said bumper and means connecting said motor means to said one of said ends of said frame member.

12. A snow plow assembly adapted to be mounted on a vehicle including a frame and a bumper supported by the vehicle frame, the snow plow assembly including a vertical frame having an upper portion and lower portion, and means for fixedly securing a portion of said vertical frame intermediate said upper and lower portions to said vehicle frame, said securing means including a pair of bracket members, one of said bracket members being rigidly secured to one lateral side of the frame intermediate the upper and lower portion and a second bracket member being rigidly secured to the opposite lateral side of said vertical frame and intermediate its upper and lower portions, each of said bracket members being adapted to be bolted to the bumper and to the vehicle frame, and means for rigidly connecting the lower portion of said vertical frame to said vehicle frame, said means for rigidly connecting including an elongated member having opposite ends, one of said opposite ends being secured to said lower portion of said vertical frame and the other of said opposite ends of said elongated member being adapted to be connected to said vehicle frame.

* * * * *